US005664968A

United States Patent [19]

Mickievicz

[11] Patent Number: 5,664,968

[45] Date of Patent: Sep. 9, 1997

[54] CONNECTOR ASSEMBLY WITH SHIELDED MODULES

[75] Inventor: Scott Keith Mickievicz, Denver, Pa.

[73] Assignee: The Whitaker Corporation, Wilmington, Del.

[21] Appl. No.: 625,591

[22] Filed: Mar. 29, 1996

[51] Int. Cl.[6] ..... H01R 13/648

[52] U.S. Cl. ..... 439/608; 439/609

[58] Field of Search ..... 439/607, 608, 439/609, 108, 79

[56] References Cited

U.S. PATENT DOCUMENTS

| | | | |
|---|---|---|---|
| 4,846,727 | 7/1989 | Glover et al. | 439/608 |
| 4,952,172 | 8/1990 | Barkus et al. | 439/532 |
| 4,975,069 | 12/1990 | Fedder et al. | 439/101 |
| 4,975,084 | 12/1990 | Fedder et al. | 439/608 |
| 5,046,960 | 9/1991 | Fedder | 439/108 |
| 5,066,236 | 11/1991 | Broeksteeg | 439/79 |
| 5,104,341 | 4/1992 | Gilissen et al. | 439/608 |
| 5,286,212 | 2/1994 | Broeksteeg | 439/609 |
| 5,342,211 | 8/1994 | Broeksteeg | 439/108 |
| 5,399,105 | 3/1995 | Kaufman et al. | 439/609 |
| 5,403,206 | 4/1995 | McNamara et al. | 439/608 |
| 5,479,321 | 12/1995 | Mair et al. | 361/816 |
| 5,484,310 | 1/1996 | McNamara et al. | 439/608 |
| 5,496,183 | 3/1996 | Glover et al. | 439/608 |

*Primary Examiner*—Khiem Nguyen
*Assistant Examiner*—Yong Ki Kim

[57] ABSTRACT

An electrical connector assembly (10) includes an insulating housing (12) and assembled thereto a plurality of terminal modules (30) and electrically conductive shields (80) therebetween. Each terminal module (30) has a plurality of contacts (36) including a mating contact portion (38), a conductor connecting portion (42) and an intermediate portion (40) therebetween with some or all of the intermediate portions encapsulated in an insulative web (56). Each of the modules (30) has an electrically conductive shield (80) mounted thereto. The connector assembly (10) is characterized in that each shield (80) includes at least a first resilient arm (98) in electrical engagement with a selected one of the contacts in the module to which the shield (80) is mounted and at least a second resilient arm (99) extending outwardly from the module and adapted for electrical engagement with an other selected contact in an adjacent terminal module (30) of the connector assembly (10).

6 Claims, 6 Drawing Sheets

CONNECTOR ASSEMBLY WITH SHIELDED MODULES

FIELD OF THE INVENTION

This invention relates to electrical connector assemblies having shielded modules serving to shield columns of adjacent terminals from crosstalk.

BACKGROUND OF THE INVENTION

It is common, in the electronics industry, to use right angled connectors for electrical connection between two printed circuit boards or between a printed circuit board and conducting wires. The right angled connector typically has a large plurality of pin receiving terminals and, at right angles thereto, pins (for example compliant pins) that make electrical contact with a printed circuit board. Post headers on another printed circuit board or a post header connector can thus be plugged into the pin receiving terminals making electrical contact therebetween. The transmission frequency of electrical signals through these connectors is very high and requires not only balanced impedance of the various contacts within the terminal modules to reduce signal lag and reflection but also shielding between rows of terminals to reduce crosstalk.

Impedance matching of terminal contacts has already been discussed in U.S. Pat. Nos. 5,066,236 and 5,496,183. Cost effective and simple designs of right angle connectors have also been discussed in these patents, whereby the modular design makes it easy to produce shorter or longer connectors without redesigning and tooling up for a whole new connector but only producing a new housing part into which a plurality of identical terminal modules are assembled. As shown in '236 patent, shielding members can be interposed between adjacent terminal modules. This requires, however, either an insert to replace the shield or a thicker terminal module to take up the interposed shielding gap if the shielding is not required. The shielding disclosed in the '236 patent has a pin receiving terminal end that is inserted into a housing module cavity and a pin contact end for contacting the printed circuit board. This shield is relatively expensive to manufacture and assemble. The shielded module disclosed in the '183 includes a plate-like shield secured to the module and having a spring arm in the plate section for electrically engaging an intermediate portion of a contact substantially encapsulated in a dielectric material. The shield further includes a pair of spring arms adjacent the board mounting face for engagement with a plated through-hole of a circuit board. This arrangement, however, requires sufficient space between adjacent through-holes of the board to avoid inadvertent short circuits. Furthermore, both the insulated module and the shield must be modified if the ground contact is to be relocated in the connector.

SUMMARY OF THE INVENTION

With respect to the above mentioned disadvantages, the object of this invention is to provide a ground shield that is capable of interconnecting to one or more selected contacts in one column or in adjacent columns of terminals to establish a desired ground pattern within the connector.

A further object of this invention, is to provide a continuous shield that extends between each column of terminals and along substantially the entire length of the contacts from the mating interface to the board interface and makes a reliable and effective electrical connection between a grounding circuit and the shield.

Yet another object of this invention is to provide a simple, cost effective shield for mounting between terminal modules of a right angled connector assembly that provides a redundant flowpath to reduce cross-talk and noise.

Another object of the invention is to provide a shield that is directly connected to selected terminals proximate the board mounting portion to provide a maximum length of parallel flowpath in the shield relative to the signal contacts, to conserve real estate on the board and to allow for closer spacing of terminals in the rows of the connector.

An object of this invention has been achieved by providing a right angle electrical connector assembly for mounting to a printed circuit board, which includes an insulating housing and assembled thereto a plurality of terminal modules and electrically conductive shields therebetween. Each terminal module has a plurality of contacts including a mating contact portion, a conductor connecting portion and an intermediate portion therebetween with at least some of the intermediate portions encapsulated in an insulative web. Each of the modules has an electrically conductive shield mounted thereto along one side thereof. The connector assembly is characterized in that each shield includes at least a first resilient arm in electrical engagement with a selected one of the contacts in the module to which the shield is mounted and at least a second resilient arm extending outwardly from the module and adapted for electrical engagement with an other selected contact in an adjacent terminal module of the connector.

Another object of this invention has been achieved by providing the aforementioned connector with a shield having a rearward portion that is mounted substantially flush in a recess of the insulative web and a forward portion that extends beyond the normal mating interface of the contacts such that a plurality of modules can be assembled side by side with the insulative webs of adjacent modules contiguous and the shield extending forwardly thereof to provide a shield flowpath that more closely parallels the signal conductors.

Yet another object has been achieved by providing the aforementioned connector with a shield having a plurality of resilient arms for engaging selected contacts in an adjacent shielded terminal module as well as selected contacts in the module to which the shield is attached.

DETAILED DESCRIPTION OF THE PREFERRED EMBODIMENT

Figure 1:
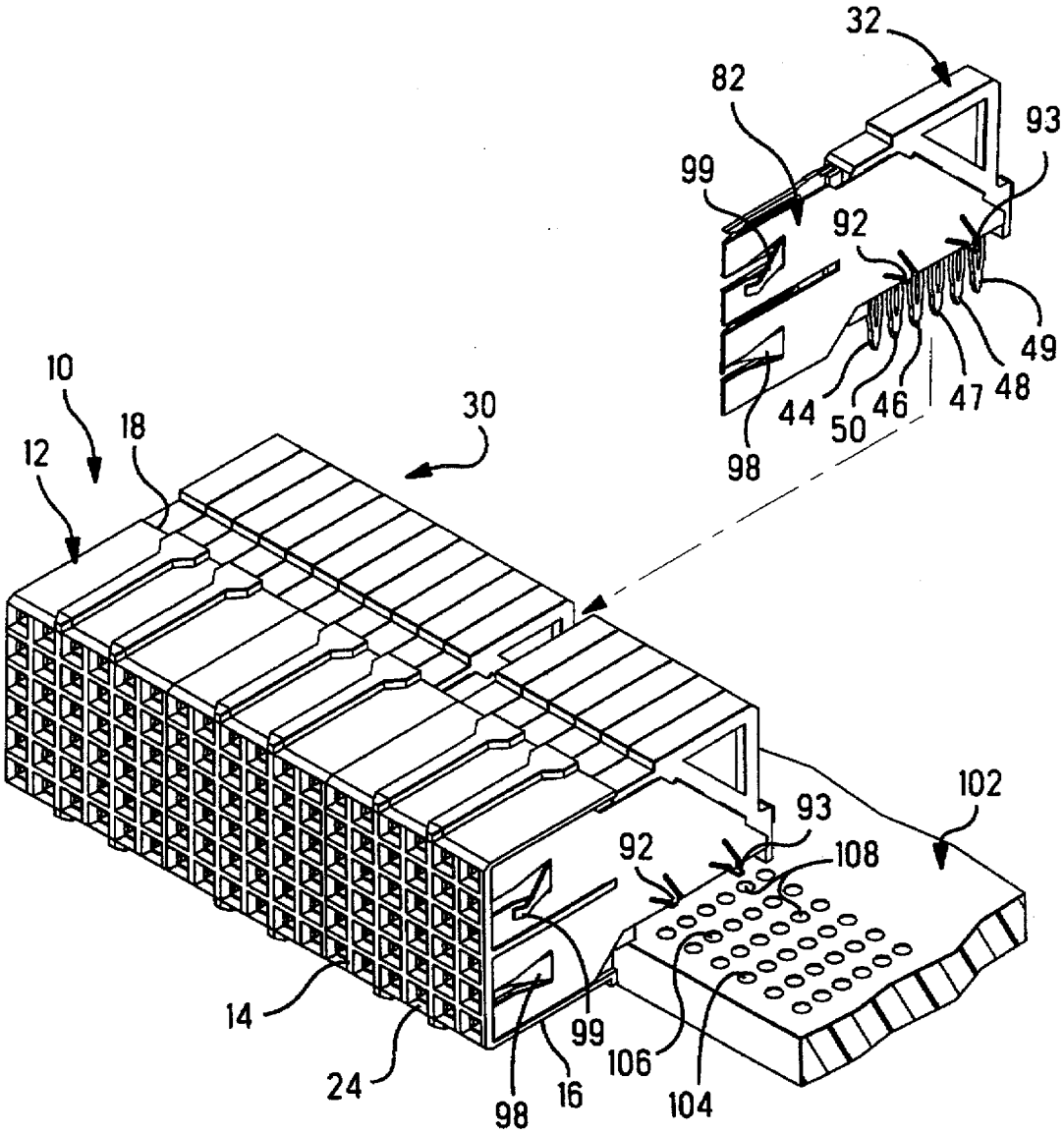
FIG. 1 is an isometric view of a portion of a connector housing having a plurality of terminal modules made in accordance with the invention disposed therein with one of the modules exploded therefrom and with the housing shown in cross section and illustrating a shield in position on an end module.
Figure 6:
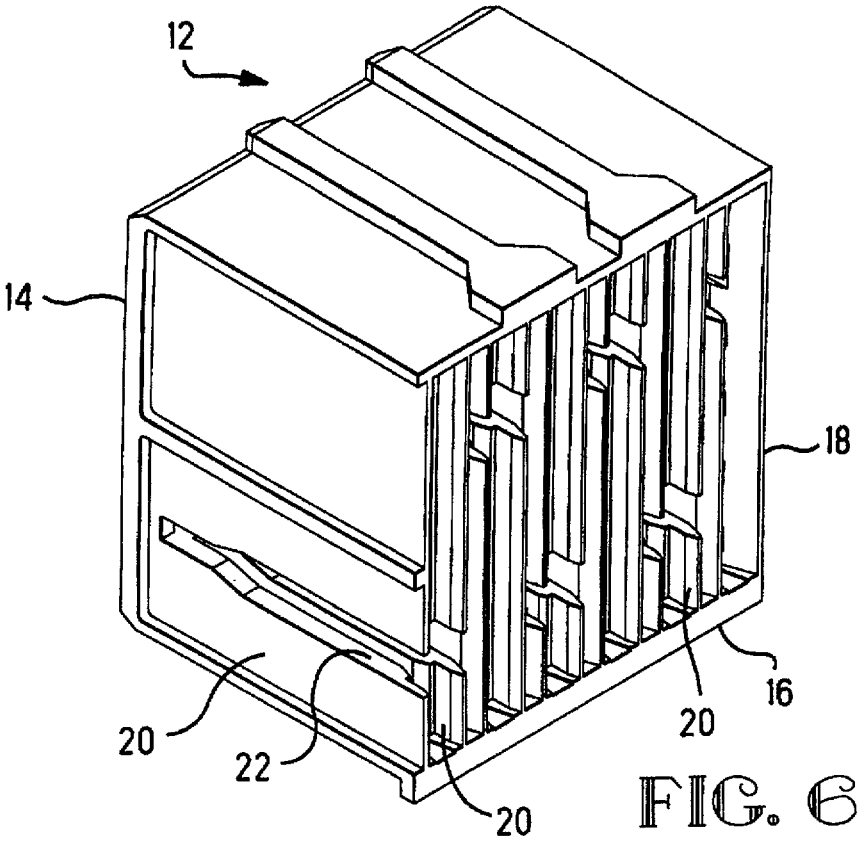
FIG. 6 is an isomeric view of a fragmentary portion of the housing of the connector in FIG. 1.
Figure 7:
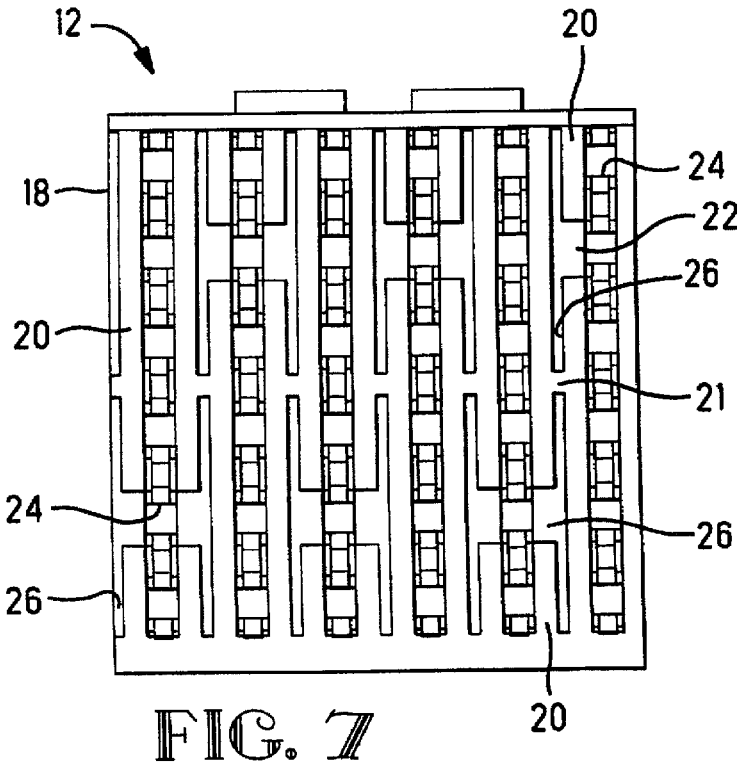
FIG. 7 is a plan view of the back of the housing of FIG. 6.

FIG. 1 illustrates a connector 10 having a housing 12 and a plurality of shielded terminal modules 30 made in accordance with the invention. Connector 10 is mounted to a circuit board 102. Housing 12 includes a mating face 14, a mounting face 16, an assembly face 18 and a plurality of terminal receiving passageways 24 extending from the mating face 14 to the assembly face 18. As best seen in FIGS. 6 and 7, the housing 12 further includes internal walls 20 having openings 22 extending from the assembly face 18 toward the mating face 14. Housing 12 further includes a plurality of shield receiving slots 26 extending from the assembly face 18 toward the mating face 14.

Figure 2:
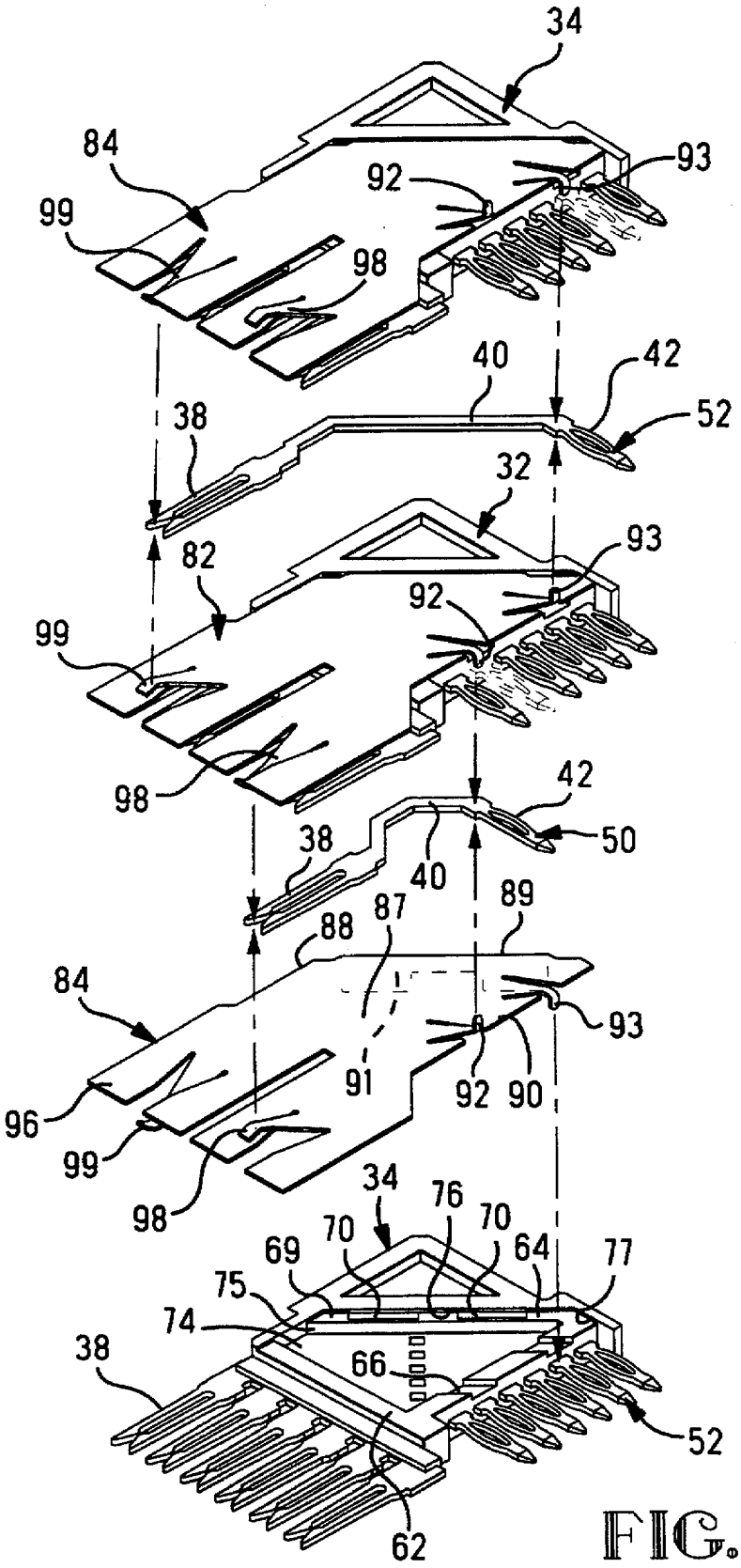
FIG. 2 is an isometric exploded view of three adjacent terminal modules with the shields made in accordance with the invention and with the ground terminals exploded from two of the modules.
Figure 3:
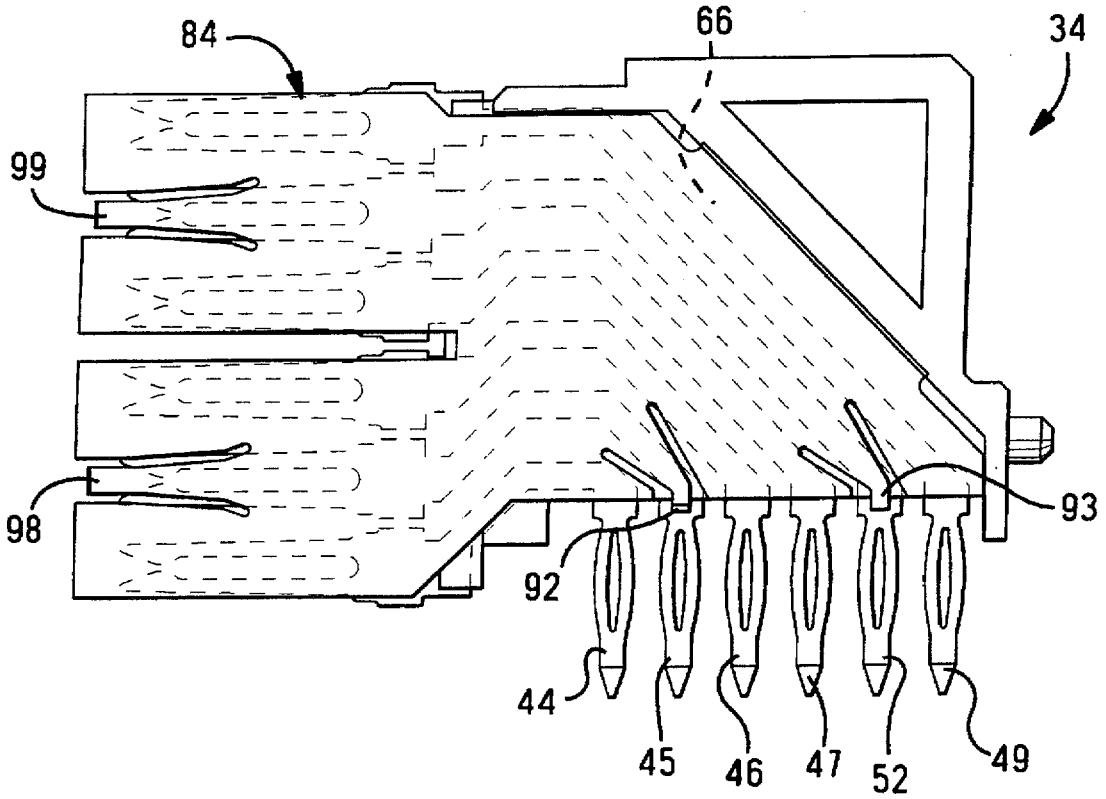
FIG. 3 is a side view of one of the terminal modules with portions of the terminals shown in phantom beneath the ground shield.
Figure 4:
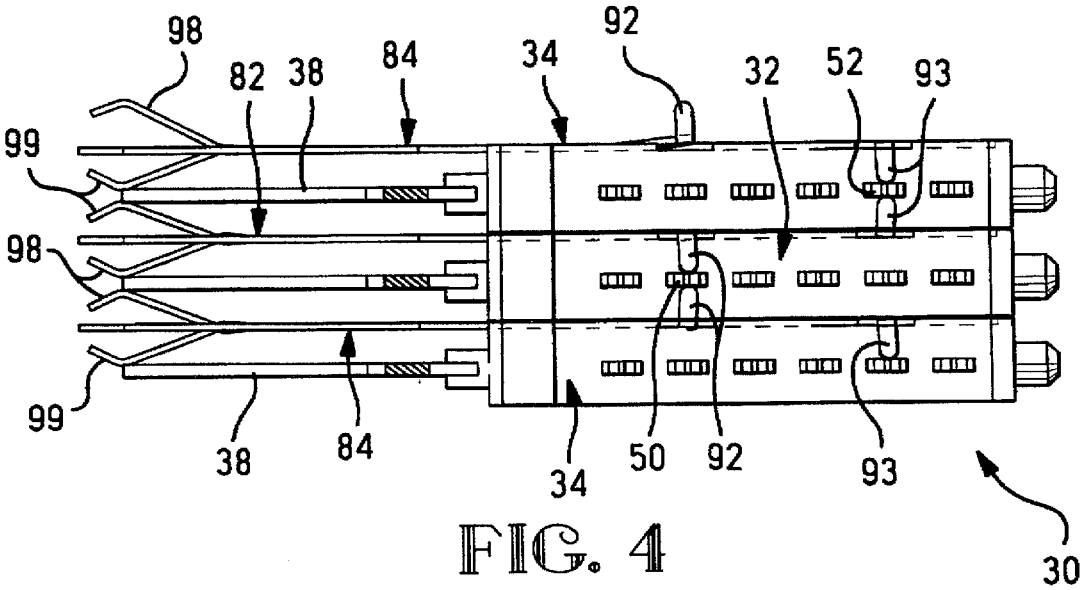
FIG. 4 is a bottom plan view of the assembled terminal modules of FIG. 2 illustrating the connection between the ground shield members and the selected ground terminals.

Referring now to FIGS. 1 through 5, the shielded terminals modules generally referred to as 30 include two embodiments 32, 34 alternately stacked together. The difference between the modules is the configuration of the ground shield members 80 that are incorporated on one side of each of the modules, as more fully explained below. In module 32, the ground shield 82 is in engagement with the contacts 50 that are in the second row of the connector and in module 34 the ground shield 84 is in engagement with the contacts 52 that are in the fifth row of the connector, resulting in the ground arrangement shown in FIG. 8. In FIG. 2, three such modules 34, 32 and 34 are shown exploded from one another and having portions of the shield and ground contacts exploded from the encapsulated modules.

Figure 5:
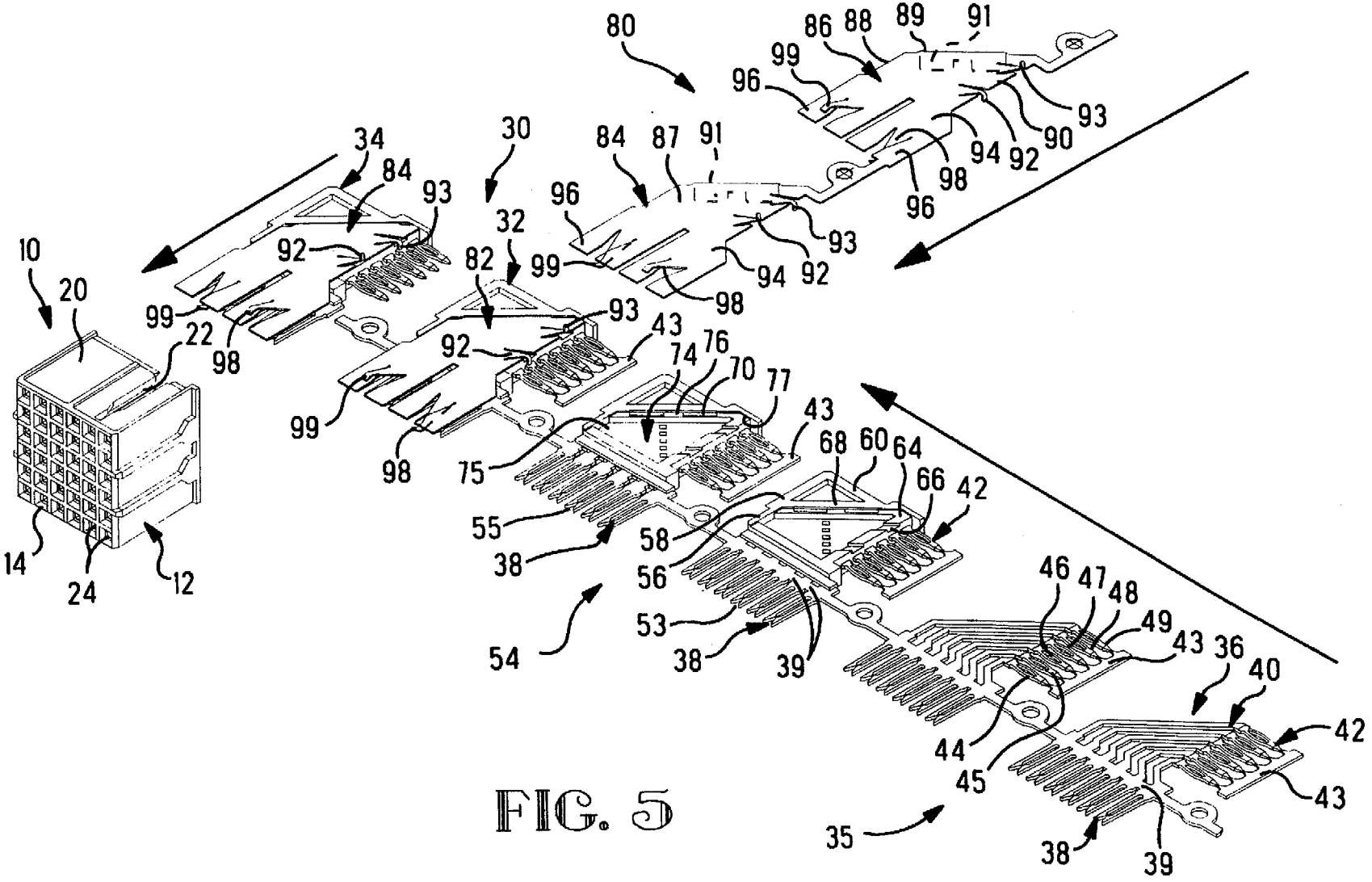
FIG. 5 is a representative view illustrating the sequential steps in the assembly of the terminal modules in accordance with the present invention.

The steps in the assembly of the shielded terminal modules 30 is shown representatively in FIG. 5 in which two terminal lead frames 35 are encapsulated to form intermediate assemblies 53,55. Respective shields 82,84 are secured to the encapsulated modules 53,55 to form modules 32,34. The structure of the shielded terminal modules 30 lends itself to automated manufacturing and assembly processes. The shielded terminal modules 30 are first shown as only partially manufactured terminal lead frames 35 having a plurality of edge stamped contacts 36, which are shown still connected to a carrier strip 37. The contacts 36 have a mating contact portion 38 for mating with pin contacts (not shown), a board connecting portion 42 for connection to a printed circuit board, and an intermediate portion 40 extending therebetween. The portions 38, 40 and 42 are formed from the same strip of sheet metal. Bridges 39 and a reinforcement strip 43 are provided to help to support the respective contact portions 38 and 42 during the manufacturing processes. After stamping of the contact arrays 35, as shown in FIG. 5, an insulative web generally shown as 56 is molded over the intermediate portions 42. The bridges 39 between the mating contact portions 38 are cut away after the overmolding process. Intermediate assemblies 53 and 55 differ only to the extent that the bridges 39 have been removed from assembly 55. The reinforcement strip 43, which helps to support the respective board contact portions 42, is maintained until the final manufacturing steps of the shielded terminal module 30. In the preferred embodiment the mating contact portions 38 are flat tuning forks to enable the distance between the forward portions of the shield and the contacts to be more constant. The board connecting portions 42 are shown as compliant pins, but solder tails may also be used.

The structure of the insulative over-molded web 56 is best understood by referring to FIGS. 2 and 5. Web 56 includes a top wall 58, a back wall 60, a front wall 62, a bottom wall 64 and an intermediate diagonal wall 68. The diagonal wall 68 includes a recessed wall portion 69, which will be described more fully herein. The diagonal, front and bottom walls 68, 62, 64 enclose an area in which the intermediate portions 40 of the contacts are encapsulated by the over-molded dielectric material, whereby this over-molded dielectric layer 74 is thinner than the walls 68, 62 and 64, thereby creating air pockets. Because of the right angled configuration of the terminal module 30, the intermediate contact portions 40 (FIG. 5) have different lengths, the different lengths of the contacts mean that they have different impedance which is undesirable for high speed data transmission, this being explained in more detail in the aforementioned patents. The air pockets serve to decrease the dielectric constant between contacts, and match the impedance of the intermediate contact portions with respect to each other, for the same reasons as disclosed in the aforementioned documents. As is further explained in these documents it is desirable to increase the speed of signal transmission in the outer contacts 48,49 and to decrease the speed of the inner contacts 44,45 so as to match signal speed transmission of outer and inner contacts thereby avoiding undesirable signal lag therebetween. This is done on the one hand by increasing the length of the intermediate portion of the inner contacts (FIG. 5) and on the other hand by decreasing the dielectric constant of the outer contacts 48,49. It is to be noted that the board connecting portions lie in a common plane even though the corresponding intermediate portions 40 do not lie in the same plane. The mating portions 38 likewise lie in a common plane.

Once again referring to FIGS. 2 and 5, the diagonal wall 68 of web 56 includes mounting holes 70, which receive mounting tabs 91 of a shield 80 in an interference fit for fastening the shield 80 thereto. The over-molded insulative web 56 also has a recess 76 defined by the inner wall surfaces 77, 78, 79, which has a thickness essentially the same thickness as the shield 80, as best seen in FIG. 2. It should be noted in FIG. 2, that the walls 58,60, and 68 have a common planar surface 67.

As seen in FIGS. 2 and 5, the shield 80 is a planar plate 86 having a rearward portion 87 defined by the contoured edges 89, 90, 91. The rearward portion 87 of the shield 80 fits within the recess 76 of the overmolded web 56, whereby the rearward portion 87 spans essentially the entire surface of the intermediate contact portions 40 in order to provide a electrically conductive shield separating adjacent terminal modules 30 of a housing assembly. The rearward shield portion 87 is essentially flush with the planar surface 67. Rearward portion 87 further includes two spaced-apart resilient arms 92, 93 extending outwardly from the plane of the shield at the board mounting edge 90 thereof and dimensioned to be received in a cooperating recess 66 along the bottom wall 64 of the web 56. The leading ends of the arms 92, 93 are bent such that they engage the selected ground terminal 50, 52 as the board mounting portion exits the web 56. The resilient arms 92, 93 are bent from the plane of plate 86, such that arm 92 will engage a board mounting contact portion in the second row of contacts and arm 94 will engage a board mounting contact portion in the fifth row of terminals that extend outwardly from the web 56.

Shield 80 also has a forward portion 94 extending outwardly over the mating portions 38 of the contacts 36 to provide a longer flowpath that more closely parallels the path of the signal conductors. Forward portion 94 has a slot 95 therein extending from leading edge toward the insulative web 56. Slot 95 is dimensioned to receive horizontal wall 21 of the housing 12 when the modules are mounted into the respective terminal receiving passageways 24 and shield receiving slots 26, as best seen in FIGS. 6 and 7. Slot 95 divides the shield 80 into two sections 96. The lower section 96 includes a resilient arm 98 that in the assembled connector, is connected to a terminal in the second row defining a ground contact 50. The upper section 96 includes a resilient arm 99 that is dimensioned to engage a terminal in the fifth row of the connector defining a ground contact 52. In the preferred embodiment the contact surfaces of arms 98, 99 lie forward of the contact surfaces of the signal terminals 38, thus assuring the ground contacts engage prior to the signal contacts in a make first-break last arrangement.

As can be seen in FIGS. 2 through 5, there are two shields 82 and 84. In the first embodiment 82 the shield is mounted to a module such that the resilient arm 92 in the rearward portion 87 of the shield and the resilient arm 98 at the forward portion 94 are electrically engaged with the second row terminal thereof thus making the second terminal a ground pin 50.

In the second embodiment 84 the shield is mounted to a module such that the resilient arm 93 of the rearward portion 87 is engaged with the fifth pin and the forward resilient finger 99 is also engaged with the fifth pin terminal defining a ground terminal 52. As can also be seen in the drawings shield 82 also includes the resilient arm 93 and forward arm 99 extending outwardly from the plane for engagement to a corresponding fifth row terminal in an adjacent module. Shield 84 similarly has the resilient arms 92, 98 extending outwardly from the plane for engagement with a second row terminal in an adjacent module. The shield 80 thus provides redundant paths for each ground connection to the board.

This interposed shielding serves to limit unwanted crosstalk between contacts of adjacent terminal modules.

As already mentioned the shields 80 are secured to web 56 by inserting the tabs 91 into the mounting holes which are held therein in an interference fit. The mounting tabs 91 are bent at an acute angle to the planar base whereas the mounting tabs 91 can only be fully inserted into the mounting holes 70 by resiliently biasing the tabs 91 outwardly such that the mounting tabs 91 from a larger angle with the planar base 86 in the same manner as described in U.S. Pat. No. 5,496,183. The planar shield base 86 is thus maintained resiliently against the walls 62 and 64 of the insulative web 56, which ensures that the planar base 86 is not only held securely against the overmolded web 56 but also remains flush to the walls thereof. The flat contact mating portions 38 enable a constant distance to be maintained between the shield and the mating portions 38.

Figure 8:
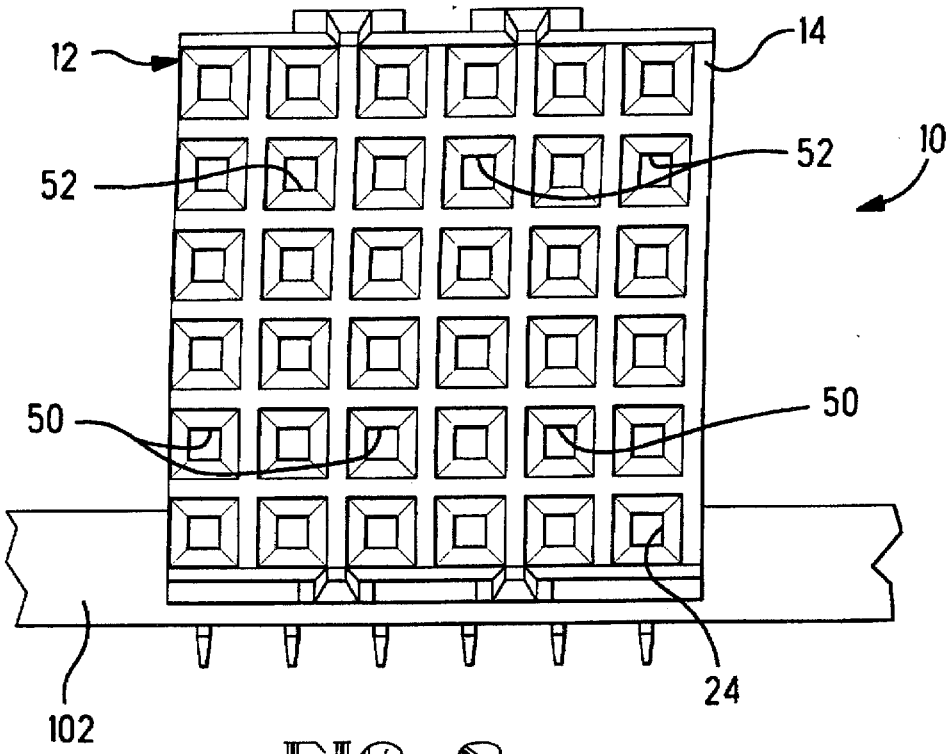
FIG. 8 is a plan view of the front of a connector made in accordance with the invention and mounted to a circuit board and illustrating the location of the ground terminals at the connector mating face.
Figure 9:
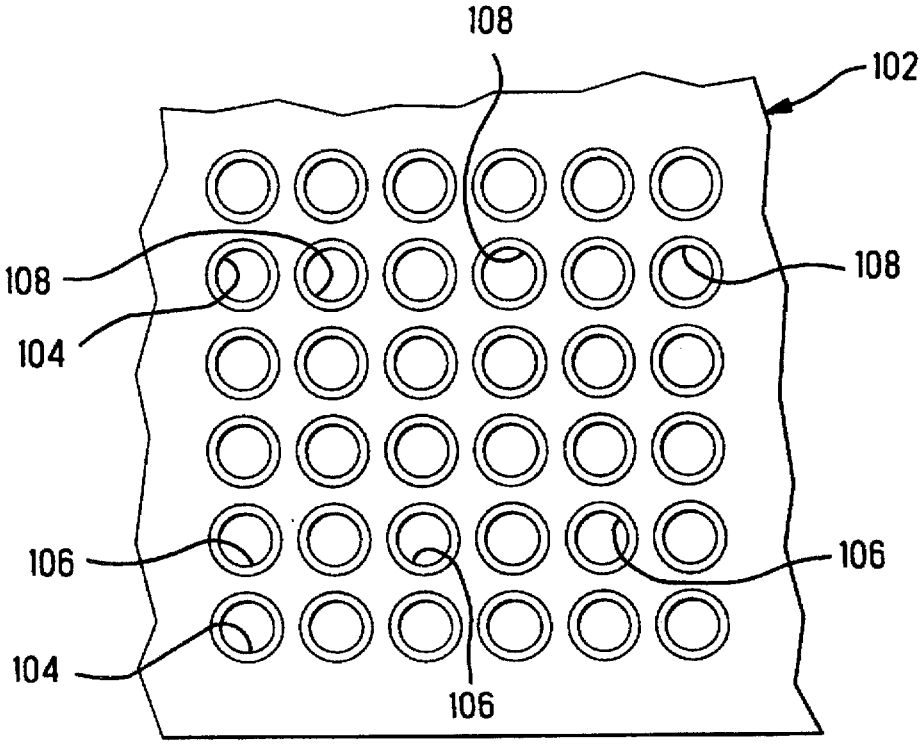
FIG. 9 is a plan view of a fragmentary portion of a circuit board having the pattern of signal and ground plated through-holes for receiving the connector shown in FIG. 8.

The terminal modules 30 of FIG. 5 are then assembled side by side to the back of housing modules 12 as disclosed in U.S. Pat. Nos. 5,066,236 and 5,496,183, whereby the pin receiving end 38 is for receiving a complementary male pin terminal and the connecting terminal end 42 is for electrical contact with through-holes of a printed circuit board. In the embodiment shown, the respective terminal ends of 42 of the signal contacts are received in through-holes 104 of circuit board 102, ground terminals 50 are received in through-holes 106 and ground terminals 52 are received in through-holes 108, as shown in FIGS. 8 and 9.

The structure of the modules of the present invention provide a signal shield with integral contact beams and a redundant flow path for the ground signals. The present design further provides a ground shield that is capable of interconnecting to one or more selected contacts in one column or in adjacent columns of terminals to establish a desired ground pattern within the connector. The shielded terminal module has a continuous shield that extends between each column of terminals and along substantially the entire length of the contacts from the mating interface to the board interface and makes a reliable and effective electrical connection between a grounding circuit and the shield. The shield is directly connected to selected terminals proximate the board mounting portion to provide a maximum length of parallel flowpath in the shield relative to the signal contacts, to conserve real estate on the board and to allow for closer spacing of terminals in the rows of the connector.

It is thought that the connector assembly with shielded modules of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector assembly comprising an insulating housing and assembled thereto a plurality of terminal modules and electrically conductive shields therebetween, each terminal module having a plurality of contacts including a mating contact portion, a conductor connecting portion and an intermediate portion therebetween with some or all of the intermediate portions encapsulated in an insulative web, each of the modules having an electrically conductive shield mounted thereto, the connector assembly characterized in that each shield includes at least a first resilient arm in electrical engagement with a selected one of the contacts in the module to which the shield is mounted and at least a second resilient arm extending outwardly from the module and in electrical engagement with an other selected contact in an adjacent module of the connector assembly.

2. The electrical connector assembly of claim 1 wherein the shield further includes a third resilient arm, the third arm being in electrical engagement with the selected terminal within the module to which the shield is mounted, one of the first and third resilient arms being in electrical engagement with the mating contact portion and the other arm being in engagement with the conductor connection portion.

3. The electrical connector assembly of claim 2 wherein the shield further includes a fourth resilient arm, the fourth arm extending outwardly from the module and in electrical engagement with the other selected contact in the adjacent module, one of the second and fourth resilient arms being in electrical engagement with the mating contact portion and the other arm being in engagement with the conductor connection portion of the selected contact.

4. An electrical connector assembly comprising:

a plurality of adjacently disposed terminal modules, where each module includes a plurality of contacts having a mating contact portion, a conductor connecting portion and an intermediate portion therebetween, and an insulative web encapsulating at least a portion of the intermediate portion; and a shield member mounted to the web, the shield having at least a first resilient arm in electrical engagement with a first selected contact in the module to which the shield is attached and at least a second resilient arm in electrical engagement with a second selected contact in an adjacent module, the first and second selected contacts being in different rows of contacts of the connector assembly.

5. The electrical connector assembly of claim 1 wherein the shield further includes a third resilient arm, the third arm being in electrical engagement with the selected terminal within the module to which the shield is mounted, one of the first and third resilient arms being in electrical engagement with the mating contact portion and the other arm being in engagement with the conductor connection portion.

6. The electrical connector assembly of claim 2 wherein the shield further includes a fourth resilient arm, the fourth arm extending outwardly from the module and in electrical engagement with the other selected contact in the adjacent module, one of the second and fourth resilient arms being in electrical engagement with the mating contact portion and the other arm being in engagement with the conductor connection portion of the selected contact.

* * * * *